United States Patent [19]

Alameddine

[11] Patent Number: 4,744,417

[45] Date of Patent: May 17, 1988

[54] METHOD FOR EFFECTIVELY HANDLING $CO_2$-HYDROCARBON GAS MIXTURE IN A MISCIBLE $CO_2$ FLOOD FOR OIL RECOVERY

[75] Inventor: Bassem R. Alameddine, Carrollton, Tex.

[73] Assignee: Mobil Oil Corporation, New York, N.Y.

[21] Appl. No.: 52,301

[22] Filed: May 21, 1987

[51] Int. Cl.[4] ..... E21B 43/30; E21B 43/40; E21B 47/00

[52] U.S. Cl. ..... 166/245; 166/252; 166/266; 166/268

[58] Field of Search ..... 166/245, 252, 266, 267, 166/268

[56] References Cited

U.S. PATENT DOCUMENTS 3,811,503 5/1974 Burnett et al. ..... 166/252
3,995,693 12/1976 Cornelius ..... 166/268
4,320,802 3/1982 Garbo ..... 166/266 X
4,415,031 11/1983 Hunt, III ..... 166/266 X
4,664,190 5/1987 Carpentier ..... 166/267

*Primary Examiner*—George A. Suchfield
*Attorney, Agent, or Firm*—Alexander J. McKillop; Michael G. Gilman; Lawrence O. Miller

[57] ABSTRACT

In a $CO_2$ miscible displacement enhanced oil recovery process, produced $CO_2$-hydrocarbon gas containing from more than the maximum $CO_2$ content tolerable in a fuel gas up to about 70 volume percent $CO_2$ is reinjected into a small portion of the well pattern volume and produced $CO_2$-hydrocarbon gas containing more than 70 volume percent $CO_2$ is reinjected into a larger portion of the well pattern volume. The method provides a more effective utilization of $CO_2$ in a $CO_2$ miscible enhanced oil recovery process while maintaining most of the oil-containing formation under miscible conditions.

6 Claims, 1 Drawing Sheet

METHOD FOR EFFECTIVELY HANDLING $CO_2$-HYDROCARBON GAS MIXTURE IN A MISCIBLE $CO_2$ FLOOD FOR OIL RECOVERY

FIELD OF THE INVENTION

This invention relates to a process for recovering oil from a subterranean, viscous oil containing formation. More particularly, this invention relates to a method for effectively handling produced $CO_2$-hydrocarbon gas mixtures in a miscible $CO_2$ displacement process for oil recovery.

BACKGROUND OF THE INVENTION

In the recovery of oil from oil-containing formations, it usually is possible to recover only minor portions of the original oil in place by the so-called primary recovery methods which utilize only the natural forces present in the formation. Thus, a variety of supplemental recovery techniques have been employed in order to increase the recovery of oil from subterranean formations. These techniques include thermal recovery methods, waterflooding and miscible flooding.

More recently, carbon dioxide has been used successfully as a miscible oil recovery agent. Carbon dioxide is a particularly desirable material because it is highly soluble in oil and dissolution of carbon dioxide in oil causes a reduction in the viscosity of the oil and increases the volume of oil all of which improve the recovery efficiency of the process. Carbon dioxide is sometimes employed under non-miscible conditions and in certain reservoirs it is possible to achieve a condition of miscibility at reservoir temperature and pressure between essentially pure carbon dioxide and the reservoir oil.

U.S. Pat. Nos. 2,875,832 and 3,995,693 disclose the use of $CO_2$-hydrocarbon gas mixtures in the recovery of oil from subterranean oil-containing formations wherein produced gas from the formation containing $CO_2$ and hydrocarbons in recycled to the formation.

The present invention provides a method for recovering oil from subterranean, viscous oil-containing formations wherein carbon dioxide is injected into the formation at pressures at or above the miscible displacement pressure to miscibly displace the oil and hydrocarbon gas to a recovery well. The improvement comprises reinjecting produced $CO_2$-hydrocarbon gas into the formation in a manner that more effectively utilizes the $CO_2$ while maintaining most of the formation under miscible conditions thereby lowering the cost of oil recovery.

SUMMARY OF THE INVENTION

The present invention relates to a method for the recovery of viscous oil from a subterranean, viscous oil-containing formation penetrated by a plurality of injection wells and a plurality of spaced apart production wells forming a well pattern comprising injecting carbon dioxide into the formation via said plurality of injection wells at or above the miscible displacment pressure to miscibly displace oil to the plurality of production wells and recovering fluids including oil and gas containing hydrocarbons from the formation via the plurality of production wells. The gas containing hydrocarbons is separated from the oil and analyzed to determine the concentration of carbon dioxide and the produced gas containing the maximum $CO_2$ content tolerable is recovered as a fuel gas. Miscible $CO_2$ displacement is continued and when the produced gas containing the maximum $CO_2$ content tolerable is recovered as a fuel gas. Miscible $CO_2$ displacement is continued and when the produced gas contains from more than the maximum $CO_2$ content tolerable in a fuel gas up to about 70 volume percent $CO_2$, the produced gas is reinjected into a small portion of the well pattern volume, preferably 30% or less pore volume, via a predetermined number of injection wells, and preferably at or above the MMP. Miscible $CO_2$ displacement is continued and when the produced gas contains more than 70 volume percent $CO_2$, the produced gas in reinjected into a larger portion of the well pattern volume, preferably more than 30% pore volume, via a predetermined number of injection wells and preferably at or above the MMP. The process is continued until the amount of oil recovered is unfavorable. In a preferred embodiment of the process, the plurality of production wells and plurality of injection wells are arranged in a five-spot regular geometric pattern.

DESCRIPTION OF THE PREFERRED EMBODIMENTS

The process of my invention is best applied to a subterranean, viscous oil-containing formation utilizing a plurality of injection wells and a plurality of production wells extending from the surface of the earth into the subterranean formation. The injection and production wells may be located and spaced from one another in any desired pattern or orientation. For example, the line drive pattern may be utilized in which a plurality of injection wells and a plurality of production wells are arranged in rows which are spaced from one another. Exemplary of other patterns which may be used as those wherein a plurality of production wells are spaced about a central injection well or, conversely, a plurality of injection wells spaced about a central producing well. Typical of such well arrays are the five-spot, seven-spot, nine-spot and 13-spot patterns. The above and other well patterns for affecting secondary recovery operations are well known to those skilled in the art and are illustrated in U.S. Pat. No. 3,927,716 to Burdyn et al, the disclosure of which is hereby incorporated by reference. Preferably, the injection wells and production wells are operated in a plurality of five-spot patterns as illustrated in FIG. 1.

Figure 1:
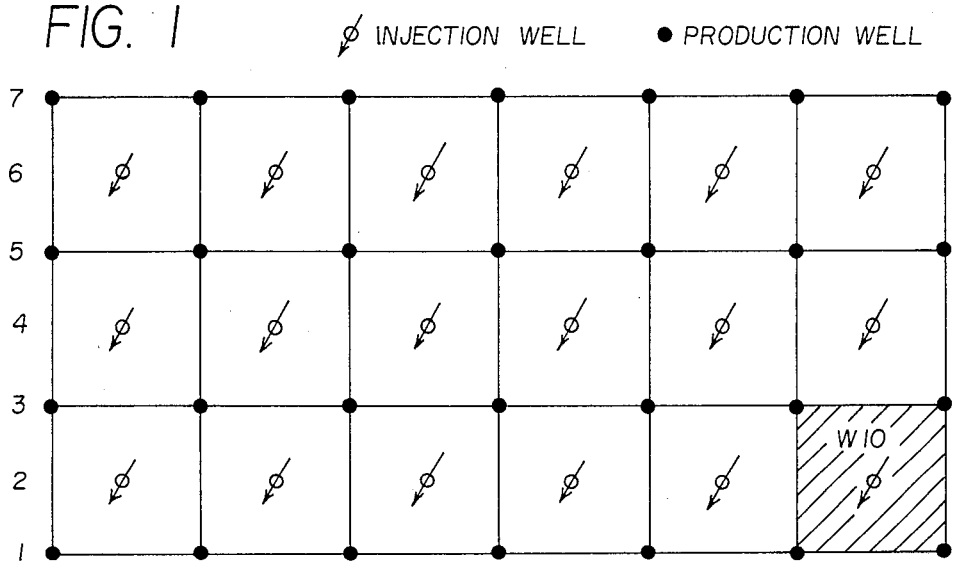
FIG. 1 is a plain view of a five-spot well pattern showing a miscible fluid drive pattern particularly adapted for the present invention.

Referring to FIG. 1, carbon dioxide is injected into the injection wells in rows (2), (4) and (6) at or above the predetermined minimum miscibility pressure (MMP) for that formation as described below. Due to its solubility in oil, when the carbon dioxide contacts the formation oil a portion of it goes into solution with the formation oil resulting in a viscosity reduction and welling of the oil thereby facilitating its displacement from the formation by the subsequent fluid drive. In addition to the viscosity reduction, there is a preferential extraction from the oil by the carbon dioxide of light intermediate hydrocarbons containing from 2 to 5 carbon atoms thereby developing an intermediate-rich carbon dioxide bank in the vicinity of the line of contact between the formation oil and the carbon dioxide. Depending upon the composition of the formation fluids and under proper conditions of formation pressure and temperature, the intermediate rich carbon dioxide bank may be completely miscible with the formation oil thereby forming a miscible transition zone with the formation oil. Depending upon the formation temperature, there is a minimum pressure at which conditional miscibility exists between the carbon dioxide and formation oil which is known as the $CO_2$ minimum miscibility pressure (MMP). Conditional miscibility is to be distinguished from instant miscibility by the fact that miscibility in a conditional miscibility sense is achieved by a series of transition multi-phase conditions described above wherein the carbon dioxide vaporizes intermediate components from the oil until it become miscible thus creating the miscible transition zone in the formation. This minimum miscibility pressure can be determined by means of slim tube displacement tests which means conditions are established simulating those of an enriched gas drive, see paper by Yellig et al entitled "Determination and Prediction of $CO_2$ Minimum Miscibility Pressure", *Journal of Petroleum Technology,* January 1980, pages 160–168, the disclosure of which is incorporated by reference. Briefly, $CO_2$ MMP is determined by the slim tube test wherein percent oil recovery of the in place fluid is determined at solvent breakthrough at given pressure conditions. By varying the pressure at constant composition and temperature, a breakpoint is determined in a curve of percent recovery versus pressure. This breakpoint is indicative of the inception of conditional miscible-type behavior.

Figure 2:
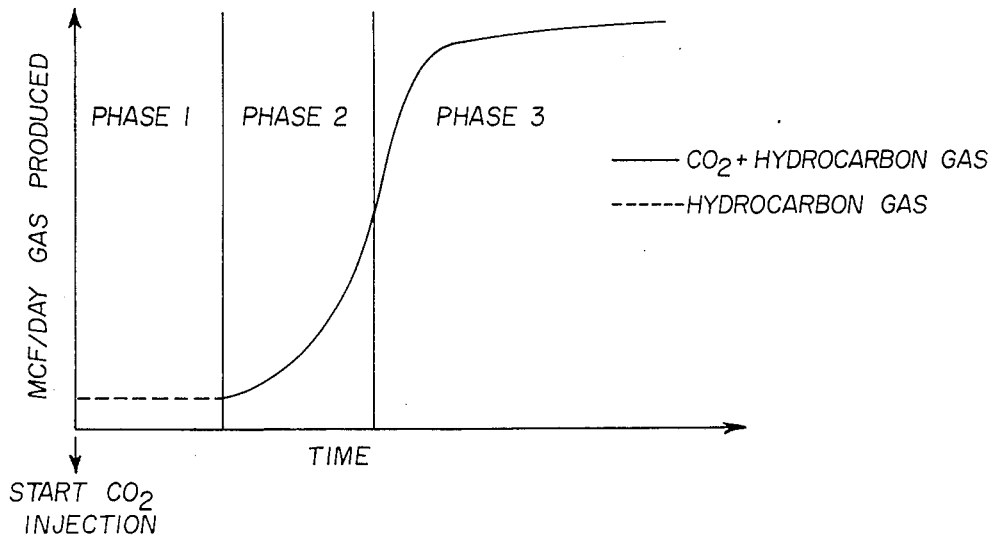
FIG. 2 illustrates the amount of $CO_2$ and hydrocarbons in the gas produced from the formation per day as a function of the time $CO_2$ is injected into the formation.

The $CO_2$ miscible fluid drive is continued thereby displacing ahead of its mobilized oil toward the production wells in rows (1), (3), (5) and (7) from which fluids including oil and gas containing hydrocarbons are recovered via the production wells. The fluids recovered from the production wells are passed into a separator so as to remove the oil from the produced gas. A small portion of the produced gas is withdrawn and analyzed to determine the concentration of $CO_2$. FIG. 2 discloses the amount of $CO_2$ and hydrocarbons in the produced gas as a function of the time $CO_2$ is injected into the formation. As shown in FIG. 2, the initial gas produced during phase 1 consists essentially of hydrocarbon gases ($C_1$, $C_2$, $C_3$ . . . ). During phase 1, the produced gas containing hydrocarbons is collected as a salable hydrocarbon gas product containing the maximum $CO_2$ content tolerable in a fuel gas. As $CO_2$ miscible displacement continues, the amount of $CO_2$ in the produced gas from the production wells increases as shown during phase 2 and 3 until the gas is predominantly carbon dioxide. During phase 2, when the produced gas contains from more than the maximum $CO_2$ content tolerable in a fuel gas up to about 70 volume percent $CO_2$, the gas is compressed and reinjected into a small portion of the well pattern volume, preferably about 30% or less pore volume of the well pattern, via a predetermined number of injection wells and preferably at or above the predetermined MMP. As shown by FIG. 1, this $CO_2$-hydrocarbon gas mixture is reinjected into only one of the five-spot patterns of the formation via the injection well designated W10. Although injection of this $CO_2$-hydrocarbon gas mixture will adversely affect the MMP, its effect will be minimized since it is confined to a small portion of the formation while $CO_2$ is being injected into the remaining portion of formation. The process is continued and when the produced gas contains more than 70 volume percent $CO_2$ during phase 3, the produced gas is injected into a larger number of the well pattern volume, preferably more than 30% pore volume of the well pattern via a predetermined number of injection wells and preferably at or above the predetermined MMP. Since the concentration of hydrocarbons in the gas mixture produced during phase 3 is lower, any adverse effect on the MMP is minimized. During injection of the produced gas containing $CO_2$ into the formation, $CO_2$ is injected into the other well patterns of the formation. The process is continued until the amount of oil recovered from the formation is unfavorable.

The benefit of this process is that the produced gas containing $CO_2$ and hydrocarbons is more effectively utilized while maintaining most of the formation under miscible conditions, thereby reducing the amount of pure $CO_2$ required for oil recovery and also making it unnecessary to install expensive processing equipment to separate the hydrocarbon gas from the $CO_2$.

By the term "pore volume" as used herein, is meant that volume of the portion of the formation underlying the well pattern employed as described in greater detail in above mentioned U.S. Pat. No. 3,927,716 to Burdyn et al, the disclosure of which is hereby incorporated by reference.

From the foregoing specification, one skilled in the art can readily ascertain the essential features of this invention and without departing from the spirit and scope thereof can adopt it to various diverse applications. It is my intention that my invention be limited and restricted only by those limitations and restrictions as appear in the appended claims.

What is claimed is:

1. In a method for the recovery of viscous oil from a subterranean viscous, oil-containing formation penetrated by a plurality of injection wells and a plurality of spaced-apart production wells forming a well pattern comprising:

(a) injecting carbon dioxide into the formation via said plurality of injection wells at the miscible displacement pressure to miscibily displace oil through the formation to said plurality of production wells and recovering fluids including oil and gas containing hydrocarbons from the formation via said plurality of production wells;

(b) separating said gas containing hydrocarbons from said oil and analyzing said gas to determine the concentration of carbon dioxide;

(c) recovering said produced gas containing the maximum $CO_2$ content tolerable in a fuel gas;

(d) continuing steps (a), (b) and (c) until the produced gas contains from more than the maximum $CO_2$ content tolerable in a fuel gas up to about 70 volume percent $CO_2$ and reinjecting said gas into a small portion of the well pattern volume via a predetermined number of injection wells;

(e) continuing steps (a), (b), (c) and (d) until the produced gas contains more than 70 volume percent $CO_2$ and reinjecting said gas into a larger portion of the well pattern volume via a predetermined number of injection wells; and (f) continuing steps (a), (b), (c), (d) and (e) until the amount of oil recovered from the formation is unfavorable.

2. The method of claim 1 wherein said plurality of production wells and said plurality of injection wells are arranged in a 5-spot regular geometric pattern.

3. The method of claim 1 wherein the $CO_2$ injected into the formation during step (a) is at pressures above the MMP.

4. The method of claim 1 wherein during step (d) the produced gs containing from more than the maximum $CO_2$ content tolerable in a fuel gas up to 70 volume percent $CO_2$ is reinjected into 30% or less pore volume of said well pattern.

5. The method of claim 1 wherein during step (e) the produced gas containing more than 70 volume percent $CO_2$ is reinjected into more than 30% pore volume of said well pattern.

6. The method of claim 1 wherein the produced gas reinjected into the well pattern volume during steps (d) and (e) is at pressures at or above the MMP.

* * * * *

UNITED STATES PATENT AND TRADEMARK OFFICE

CERTIFICATE OF CORRECTION

PATENT NO. : 4,744,417

DATED : May 17, 1988

INVENTOR(S) : B.R. Alameddine

It is certified that error appears in the above—identified patent and that said Letters Patent is hereby corrected as shown below:

Column 5, line 9, "gs" should be --gas--.

Signed and Sealed this

First Day of November, 1988

*Attest:*

DONALD J. QUIGG

*Attesting Officer*

*Commissioner of Patents and Trademarks*